US005692927A

United States Patent [19]

Tiihonen et al.

[11] Patent Number: 5,692,927

[45] Date of Patent: Dec. 2, 1997

[54] CONNECTION ARRANGEMENT

[75] Inventors: Markku J. Tiihonen, Oulunsalo; Jari E. Lapinlampi, Oulu, both of Finland

[73] Assignee: ADC Solitra Oy, Kempele, Finland

[21] Appl. No.: 537,252

[22] Filed: Sep. 29, 1995

[30] Foreign Application Priority Data

Oct. 5, 1994 [FI] Finland ..... 944667

[51] Int. Cl.[6] ..... H01R 17/04

[52] U.S. Cl. ..... 439/675; 439/581; 439/63

[58] Field of Search ..... 439/434, 578, 439/675, 63, 581, 582

[56] References Cited

U.S. PATENT DOCUMENTS

| | | | |
|---|---|---|---|
| 2,552,414 | 5/1951 | Eriksen et al. | 439/434 |
| 3,594,687 | 7/1971 | Alderfer | 439/581 |
| 3,858,156 | 12/1974 | Zarro | 439/675 |
| 5,274,347 | 12/1993 | Bobadilla | 439/434 |
| 5,453,025 | 9/1995 | Wilson | 439/578 |

FOREIGN PATENT DOCUMENTS

| | | | |
|---|---|---|---|
| 2238266 | 2/1975 | France | 439/581 |

OTHER PUBLICATIONS

IBM Technical Disclosure Bulletin vol. 16 No. 10, Mar. 1974 "Annular Ring Coaxial Termination" by R. T. Evans.

*Primary Examiner*—Gary F. Paumen
*Assistant Examiner*—Tho D. Ta
*Attorney, Agent, or Firm*—Ladas & Parry

[57] ABSTRACT

The invention relates to a connection arrangement, in particular an intermodulation-protected coaxial radio-frequency connection arrangement. The arrangement comprises interconnected connector parts (1, 101), wherein each connector part (1, 101) comprises a body (2, 102) and an outer contact member (3, 103) coupled to the body and each connector part (1, 101) further comprises an inner contact member (4, 104), the outer contact members (3, 103) of the connector parts being interconnected and the inner contact members (4, 104) of the connector parts being interconnected. In the connection arrangement, one connector part (101) is attached to an abutment surface (200) provided with a through hole (201) and the other connector part (1) is coupled to the connector part (101) attached to the abutment surface (200). The invention is characterized in that in the connector part (101) attached to the abutment surface, the outer contact member (103) of the connector part consists the same piece of material as the body (102) of said connector part. The means for preventing axial movement of the inner contact member (104) of the connector part (101) attached to the abutment surface (200) is a means that is not included in the connector part (101).

1 Claim, 2 Drawing Sheets

CONNECTION ARRANGEMENT

Figure 1:
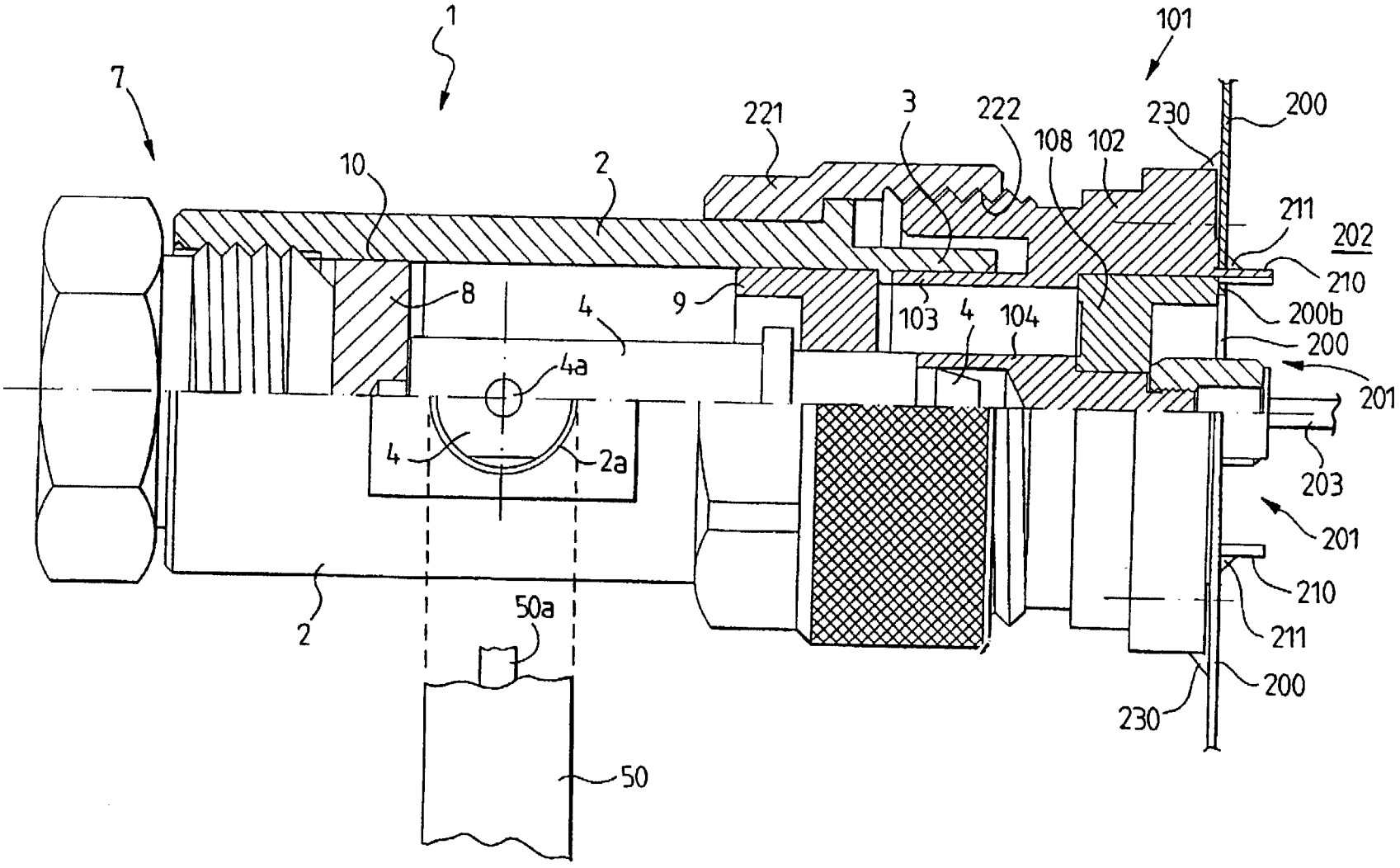

The present invention relates to a connection arrangement, in particular an intermodulation-protected coaxial radio-frequency connection arrangement comprising interconnected connector parts, wherein each connector part comprises a body and an outer contact member coupled to the body and each connector part further comprises an inner contact member, the outer contact members of the connector parts being interconnected and the inner contact members of the connector parts being interconnected, and in which connection arrangement one connector part is attached to an abutment surface provided with a through hole and the other connector part is coupled to the connector part attached to the abutment surface, the connection arrangement further comprising means for preventing axial movement of the inner contact member of the connector part attached to the abutment surface.

A connection arrangement of the above kind is applied in connections for the radio frequency range, for example in connections for filters used at a base station of a cellular network. These connection arrangements employ connector parts, such as a free connector and a mating fixed connector. The male free connector is a connector part to which for instance a coaxial cable from the antenna of a base station is coupled. The female fixed connector in turn is a connector to be attached to the wall (side, bottom etc.) of a filter or to an equivalent abutment surface at the location of a through hole, to which the free connector is coupled.

In connection arrangements for the radio frequency range, a significant problem is presented by intermodulation, which is induced as a combined result of several frequencies. Intermodulation may present a problem particularly at base stations for cellular networks, since several transmission frequencies are employed for different channels at one base station unit, thus causing intermodulation to occur. Intermodulation becomes a real problem when the frequency of the intermodulation is in the same frequency range as the receiving frequency of the base station. Even a small intermodulation will cause problems, as the difference between the transmit power and the intermodulation should be as high as 165 dB. The unit and value for the intermodulation is dependent on the smoothness of the component surfaces and the clamping force between the interconnected parts of the arrangement.

In prior art connection arrangements, for example the fixed connector, i.e. the connector part attached to the abutment surface, is a connector part in which the sleeve-like outer contact member is constructed of a separate piece of material and supported to the body with a boron joint or otherwise. Furthermore, this prior art fixed connector is such that prevention of axial movement of the inner contact member has been effected with a locking member threaded into the body. In known connection arrangements, also the free connector is such that the sleeve-like outer contact member is of a separate piece of material from the body.

Connection arrangements implemented with connector parts of the above type are attended by several problems. In such prior art connection arrangements, intermodulation protection will be insufficient, as the body of the connector part attached to the abutment surface comprises three discrete parts. In the applicant's observation, the greater the number of parts included in the body, the greater the likelihood of harmful intermodulation is. Every interface, such as a boron joint or threaded joint, between the different parts of the body will enhance harmful intermodulation, because in the radio frequency range current propagates along surfaces, such as the interface in a boron joint or threaded joint. The problem is aggravated if the connection arrangement is exposed to vibration, for instance. Furthermore, the prior art connection arrangements are problematic in terms of the manufacture and assembly of the connector parts, since in them the body comprises several parts each made of a separate piece of material that are interconnected.

It is an object of the present invention to provide a novel connection arrangement avoiding the problems of the prior art.

This object is achieved with the connection arrangement of the invention, which is characterized in that in the connector part attached to the abutment surface, the outer contact member of the connector part consists of the same piece of material as the body of said connector part, and that the means for preventing axial movement of the inner contact member of the connector part attached to the abutment surface is a means that is not included in the connector part.

The connection arrangement of the invention affords a number of advantages. Protection against intermodulation is considerably better in the present connection arrangement than in the prior art approaches, on account of the fact that the body only comprises one piece of material, and thus no boron joints or threaded joints that would enable radio frequency current to propagate and hence intermodulation to be induced are present. The invention achieves improvement of the outer contact of a coaxial connection arrangement. The connection arrangement will be mechanically very stable, and the novel solution is also of simple construction and inexpensive to manufacture and assemble.

Figure 3:
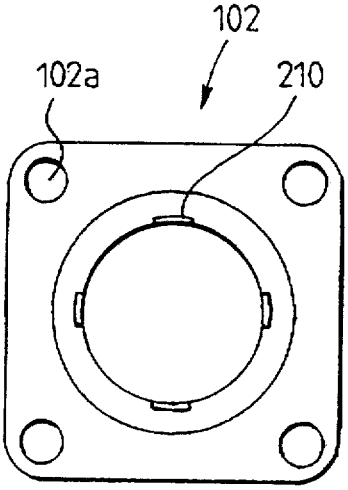
Figure 2:
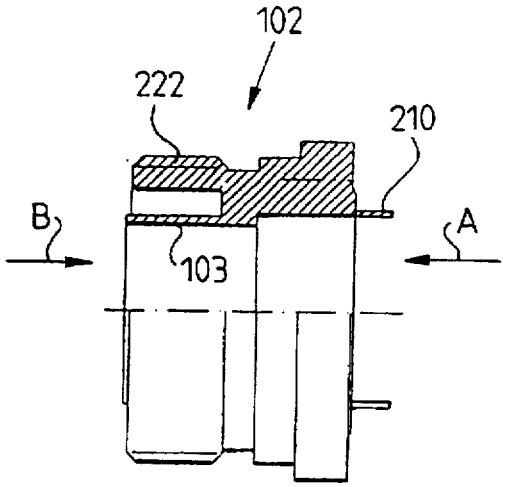
Figure 4:
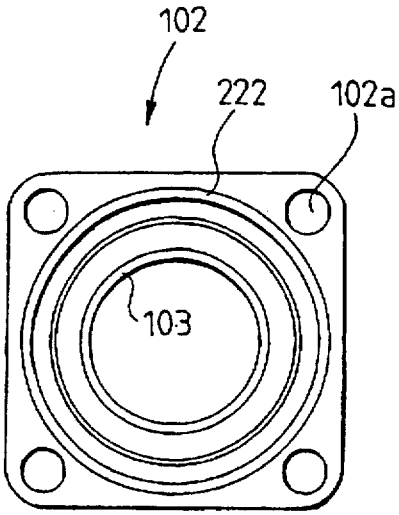
Figure 5:
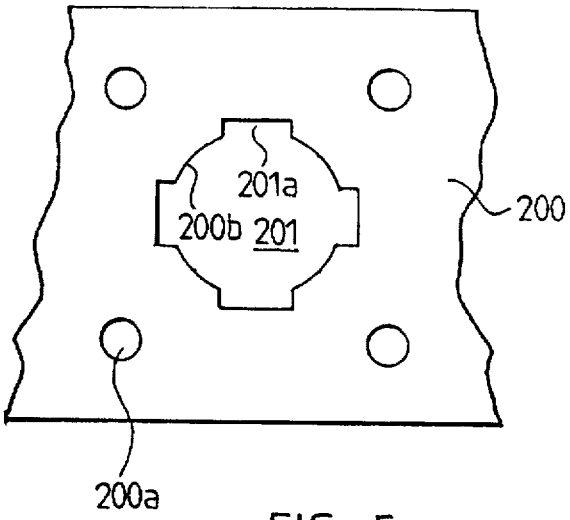

In the following the invention will be explained in greater detail with reference to the accompanying drawings, in which FIG. 1 is a partial sectional side view of a connection arrangement, FIG. 2 is a partial sectional view of a body of a fixed connector employed as a connector part in the connection arrangement, FIG. 3 shows the body of the fixed connector employed as a connector part in the connection arrangement in the direction of arrow A of FIG. 2, FIG. 4 shows the body of the fixed connector employed as a connector part in the connection arrangement in the direction of arrow B of FIG. 2, and FIG. 5 shows an abutment surface at the location of a through hole.

With reference to the figures, specifically FIG. 1, the invention relates to a connection arrangement, in particular to an intermodulation-protected coaxial radio-frequency connection arrangement comprising interconnected connector parts 1 and 101. The figures depict connector parts, i.e. connectors 1 and 101, in accordance with the 7/16 connector standard. Connector parts 1 and 101 comprise bodies 2 and 102 and outer contact members 3 and 103 connected to the bodies 2 and 102. The connector parts also comprise inner contact members 4 and 104. The inner contact member 4 of connector part 1 is a centre pin, and the inner contact member 104 of connector part 101 is a counterpart for the centre pin. To produce a coaxial connection arrangement, the outer contact members 3 and 103 of the connector parts 1 and 101 are interconnected and the inner contact members 4 and 104 of the connector parts 1 and 101 are interconnected.

Connector part 1 is a male connector part and connector part 101 a female connector part. Connector part 1 is preferably a free connector whereto a coaxial cable 50 can be coupled. Connector part 101 is preferably a fixed connector that can be attached for instance to a radio frequency filter housing construction, such as a wall, bottom or an equivalent abutment surface 200, serving as a mounting frame for the connector part 101. Attachment of the connector part 101 to the abutment surface 200 can be performed with fixing means such as bolts and nuts through holes 102*a* in the body 102 of connector part 101 and holes 200*a* in the abutment surface 200. The abutment surface 200 comprises a through hole 201. The filter, mainly the interior of the housing construction of the filter, is denoted by reference numeral 202. Via the through hole 201, the inner contact member, i.e. the counterpart 104 for the centre pin, can contact a conductor 203 within the filter 202, for instance a conductor from a resonator.

Connector part 1 further comprises clamping means 7 offsetting the inner contact member 4 in relation to the body 2 for clamping the inner contact member 4 of said connector part 1 in the axial direction against the inner contact member 104 of the second connector part 101. Furthermore, connector part 1 comprises two intermediate pieces 8 and 9 of insulative material and a sliding surface 10. The body 2 of connector part 1 comprises an attachment point 2*a* for the sheath of a coaxial cable 50. The inner contact member of connector part 1, i.e. the centre pin 4, comprises an attachment point 4*a* for the inner conductor 50*a* of the coaxial cable 50.

Hence one connector part in the connection arrangement, i.e. the fixed connector 101, is attached to an abutment surface 200 provided with a through hole 201, and the other connector part 1 is coupled to connector part 101 that is attached to the abutment surface 200.

It is essential in the connection arrangement of the invention that in the connector part 101 attached to the abutment surface 200, the outer contact member 103 of the connector part consists of the same piece of material as the body 102 of said connector part 101. The body 102 and outer contact member 103 are of one piece, for instance of brass. The connection arrangement comprises means for preventing axial movement of the inner contact member 104 of connector part 101. It is further essential in the connection arrangement of the invention that the means for preventing axial movement of the inner contact member 104 of connector part 101 attached to the abutment surface 200 is a means that is not included in connector part 101, specifically a means that is not included in the body 102 of connector part 101. In a preferred embodiment, the connection arrangement is such that the means preventing axial movement of the inner contact member 104 of connector part 101 attached to the abutment surface 200 is part of the structural unit (filter 202) to which connector part 101 is attached. In a preferred embodiment, the connection arrangement is such that the means preventing axial movement of the inner contact member 104 of connector part 101 attached to the abutment surface 200 is specifically the abutment surface 200 to which connector part 101 is attached. Such an embodiment is simple, as it does not require any separate structural parts for the purpose.

In a preferred embodiment, the means for preventing axial movement of the inner contact member is constituted by the edges 200*b* of the through hole 201 provided in the abutment surface 200.

The connection arrangement is such that connector part 101 attached to the abutment surface 200 comprises an insulative intermediate piece 108 between the inner contact member 104 and the body 102, also aligning the inner contact member 104. Thus in a preferred embodiment the abutment surface 200, 200*b* is adapted to prevent movement of the inner contact member 104 by means of the insulative intermediate piece 108. The abutment surface 200, 200*b* is thus adapted to prevent movement of the intermediate piece 108, and the intermediate piece 108 in turn is adapted to prevent movement of the inner contact member 104. Prevention of movement means that the inner contact member 104 of connector part 101 is incapable of moving to the right in FIG. 1 when the inner contact member 4 of connector part 1, i.e. the centre pin 4, is clamped with the clamping means 7 against the inner contact member 104 of connector part 101, i.e. the counterpart 104 for the centre pin.

In a preferred embodiment, the insulative intermediate piece 108 is of a greater diameter than the through hole 201 provided in the abutment surface 200. Thus prevention of the movement of the inner contact member can be implemented with a simple construction that can be realized at low cost.

In a preferred embodiment, the connection arrangement is such that the body 102 of connector part 101 attached to the abutment surface 200 further comprises attachment lugs 210 constructed as an integral part of the body, preferably soldering lugs or equivalent, extending through the through hole 201 provided in the abutment surface 200. Thus the connection arrangement comprises solder joints 211 or equivalent between the attachment lugs 210 and the interior of the abutment surface construction 200. This embodiment affords the advantage that the outer contact of the coaxial connection can be brought within the abutment surface 200, such as the housing construction of a filter 202.

The abutment surface 200, preferably the through hole 201 provided in the abutment surface, comprises recesses 201*a* or equivalent for the attachment lugs of the body 102 of connector part 101, and thus there will be space for the attachment lugs 210, but the abutment surface 200, 200*b* is still capable of preventing movement of the intermediate piece 108 and hence also of the inner contact member 104 when the inner contact members 4, 104 are clamped against one another with the clamping means 7.

Also in connector part 1 which is coupled to connector part 101 attached to the abutment surface 200, the outer contact member 3 consists of the same piece of material as the body 2 of the connector part. This preferred embodiment further improves protection against intermodulation, reduces the number of structural parts required, and facilitates the manufacture and assembly.

Between connector parts 1 and 101 on the exterior of the connection arrangement, the arrangement comprises a clamping construction 221, 222 which includes outer clamping means 221 incorporated in the first connector part 1 and a threaded portion 222 provided in the body 102 of the second connector part 101. The clamping construction 221, 222 is a conventional exterior clamping construction for clamping the bodies 2 and 102 of the connector parts 1 and 101 together.

When the connection arrangement is assembled of complete connector parts 1 and 101, firstly connector part 101 is attached to the abutment surface 200 by means of holes 102*a* and 200*a* and bolts to be threaded therein, which is followed by making the necessary solder joints, including the solder joints 211 between the attachment lugs 210 and the interior of the abutment surface 200 and the solder joint 230 between the body 102 of connector part 101 and the exterior of the abutment surface 200. As a next step, connector part 1 is pushed into connector part 101, whereupon the outer contact members 3 and 103 are interconnected and the inner contact members 4 and 104 are interconnected. Subsequently the bodies 2 and 102 are clamped together with the clamping construction 221, 222, and thus also the inner contact members 4 and 104 are clamped to some extent. As a last step, the inner contact members, i.e. the centre pin 4 and its counterpart 104, are clamped by turning the clamping means 7 by way of the intermediate piece 8 towards the centre pin. The movement of the clamping means 7 along the thread of the interior surface of the body 2 produces a sliding movement of the intermediate piece 8 on the sliding surface 10, and thus the intermediate piece 8 pushes the centre pin 4 ahead of it, causing the centre pin 4 to be pushed against the inner contact member 104 of connector part 101, i.e. of the fixed connector 101, i.e. against the counterpart 104 of the centre pin. In accordance with the invention, the abutment surface 200 prevents the inner contact member 104 from escaping by means of the intermediate piece 108.

Even though the invention has been described in the foregoing with reference to the examples in accordance with the accompanying drawings, it is obvious that the invention is not to be so restricted, but it can be modified in a variety of ways within the scope of the inventive idea disclosed in the appended claims.

We claim:

1. A connection arrangement comprising:

a body (102) having an outer contact member (103);

an inner contact member (104) radially inward from the outer contact member (103);

an abutment surface (200) having a through hole for a connection to the inner contact member (4);

attachment means for attaching the body (102) to the abutment surface (200);

coupling means on the body (102) for coupling to a connector (1) when the body (102) is attached to the abutment surface (200); and means for preventing axial movement of the inner contact member (104) relative to the body (102) when the body (102) is attached to the abutment surface (200), wherein the means for preventing axial movement of the inner contact member (104) is on the abutment surface.

* * * * *